US009332622B1

(12) United States Patent
Dutt

(10) Patent No.: US 9,332,622 B1
(45) Date of Patent: May 3, 2016

(54) LIGHTING CONTROL SYSTEM

(71) Applicant: Rajendra Dutt, Frisco, TX (US)

(72) Inventor: Rajendra Dutt, Frisco, TX (US)

( * ) Notice: Subject to any disclaimer, the term of this patent is extended or adjusted under 35 U.S.C. 154(b) by 0 days.

(21) Appl. No.: 14/687,735

(22) Filed: Apr. 15, 2015

Related U.S. Application Data

(60) Provisional application No. 61/980,352, filed on Apr. 16, 2014.

(51) Int. Cl.
*H05B 37/02* (2006.01)

(52) U.S. Cl.
CPC ..... *H05B 37/0272* (2013.01); *H05B 37/02* (2013.01)

(58) Field of Classification Search
CPC ..... H05B 37/02
USPC ..... 315/291, 307, 308, 312, 360
See application file for complete search history.

(56) References Cited

U.S. PATENT DOCUMENTS

| | | | | |
|---|---|---|---|---|
| 7,348,736 | B2 | 3/2008 | Piepgras | |
| 7,856,152 | B2 | 12/2010 | Diederiks | |
| 2012/0026726 | A1 * | 2/2012 | Recker et al. | 362/157 |
| 2012/0274670 | A1 | 11/2012 | Lee | |
| 2013/0147366 | A1 * | 6/2013 | Huizenga | H05B 37/02 315/152 |
| 2013/0176481 | A1 | 7/2013 | Holmes | |
| 2013/0221852 | A1 | 8/2013 | Bowers | |
| 2013/0221857 | A1 | 8/2013 | Bowers | |
| 2015/0366039 | A1 * | 12/2015 | Noori | H05B 37/0272 315/307 |

* cited by examiner

*Primary Examiner* — Tung X Le
(74) *Attorney, Agent, or Firm* — QuickPatents, LLC; Kevin Prince

(57) ABSTRACT

A lighting system for emulating at a first location the lighting conditions of a remote location includes a lighting control circuit that controls the brightness and color of each of a plurality of lamps at the first location. The lighting control circuit further includes a power source, a networking module that is adapted to receive lighting scene information, via a network, a non-transitory storage medium, and optionally at least one mirror. A remote command module is accessible by the networking module of the control circuit and is adapted to provide the lighting scene information to the lighting control circuit. The remote command module is preferably resident at least in part in a portable electronic device of a user. Alternately, the remote command module may be resident on the remote network server that is in communication with the networking module of the lighting control circuit through the network.

12 Claims, 2 Drawing Sheets

LIGHTING CONTROL SYSTEM

CROSS-REFERENCE TO RELATED APPLICATIONS

This application claims the benefit of U.S. Provisional Patent Application 61/980,352, filed on Apr. 16, 2014, and incorporated herein by reference.

STATEMENT REGARDING FEDERALLY SPONSORED RESEARCH AND DEVELOPMENT

Not Applicable.

FIELD OF THE INVENTION

This invention relates to lighted mirrors, and more particularly to a system for adjusting lighting conditions of a lighted mirror.

DISCUSSION OF RELATED ART

When preparing for special events, such as weddings, other celebrations, or just a night on the town, participants want to know that they will look their best for the occasion. Dress and makeup can go a long way towards optimizing one's appearance, but one's appearance at a first location in a mirror at home or at a wedding dress retail establishment greatly depends on the lighting conditions at that location, not the lighting conditions at the remote location of the celebration. As such, one's appearance may be somewhat drastically different at the remote location when compared to the first location, due to different lighting conditions. Heretofore it has been unrealistically to know what the lighting conditions at the remote location are likely to be, and even more difficult to emulate such lighting conditions at the first location where the user is getting dressed, applying makeup, and the like.

U.S. Pat. No. 7,856,152 to Diederiks et al. on Dec. 21, 2010 teaches a lighting simulation system for emulating a lighting environment of a first location at a second location. Such a system, however, requires the user to utilize a light condition recorder at the desired first location and either bring the light condition recorder to the light simulator and lamp system or connect the light condition recorder to the light simulator through a cellular phone network. Such an arrangement is impractical for simulating the lighting conditions of any of several remote location venues easily at a bridal shop, for example, as the user would necessarily have to travel to each potential venue to determine the light conditions at that venue. Further, no accommodation is made in such a system for taking the time of day, weather, and the like at the venue into consideration. Such a system makes no provision for a community of contributors contributing to a library of venues each having a plurality of time and weather parameters. Moreover, such a device allows the user to make adjustments to the lighting scene, which introduces a variable that can cause the lighting scene to be changed considerably from the first location in ways that the user may not appreciate or understand.

Therefore, there is a need for a system that allows the lighting conditions at a remote location to be emulated at a user's location while preparing his or her appearance. Such a needed invention would be relatively simple to operate, and would allow the user to utilize lighting scene information collected by all of the users in a network. Further, such a needed system would take time and date parameters into account, so as to allow for a very close approximation of the lighting conditions of the remote location at the first location. Further, retail establishments would be able to utilize such a device to enhance their business by allowing customers the ability to control lighting conditions at the retail location based on any desired remote location. The present invention accomplishes these objectives.

SUMMARY OF THE INVENTION

The present device is a lighting system for emulating at a first location the lighting conditions of a remote location. Lighting scene information can be collected at the remote location, such as a wedding venue, nightclub, or the like, by conventional means, such as light measuring apparatus (not shown), a camera of a portable electronic device of a user, or the like. Such lighting scene information is stored in a "lighting scene" file stored in a non-transient storage medium of a remote network server, or stored on a non-transient storage medium of the portable electronic device, or the like.

Each lighting scene is associated with the particular remote location and optionally other parameters such as time of day, time of year, weather conditions, and the like. As such, the lighting scenes of the location at a given time of year, a given time of day, and with given weather conditions may be stored for later recall by the lighting system.

A lighting control circuit includes a plurality of lamps at the first location. The control circuit is adapted to adjust the color and brightness of each of the lamps to correspond with one of the plurality of lighting scenes. The lighting control circuit further includes a power source, a networking module that is adapted to receive lighting scene information, via a network, a non-transitory storage medium, and optionally at least one mirror near the lamp.

A remote command module is accessible by the networking module of the control circuit and is adapted to provide the lighting scene information of a lighting scene file to the lighting control circuit. As such, the networking module receives the lighting scene information from the remote command module and the lighting control circuit emulates the lighting scene at the first location by adjusting the color and brightness of each of the lamps according to the lighting scene information for a particular lighting scene.

The remote command module is preferably resident in a non-transitory storage medium of the portable electronic device of a user. The portable electronic device is in wireless communication with the networking module of the lighting control circuit. As such, the user may command a change the lighting scene of the lighting system by using the portable electronic device, selecting from one of a plurality of the lighting scenes that are either stored on the portable electronic device or that are available for download over the network, for example.

The portable electronic device may be in direct wireless communication with the networking module of the lighting control circuit via a Bluetooth, WiFi, or other wireless connection protocol on a local wireless network, for example. The portable electronic device is preferably a smart phone, but may also be a dedicated remote control type of device (not shown), table computer, or the like.

In one embodiment, the remote command module is resident on the remote network server that is in communication with the networking module of the lighting control circuit through the network. As such, the user may change the lighting scene of the lighting system by using the network server via the network. The portable electronic device in such an embodiment is capable of communicating the unique identification code of the lighting system to the remote network server, so that the remote network server knows which lighting control circuit on the network to command.

The lighting system may further include an indicia, such as a QR code, fixed proximate the plurality of lamps. The indicia correspond to the unique identification code and may also be associated with a unique network address of the remote network server. In use the user, after scanning the indicia or QR code with a camera of the portable electronic device, is afforded control of the lighting system by the remote network server through the user's portable electronic device. At least a portion of the command module is resident on the portable electronic device in such an embodiment.

The present invention is a system that allows the lighting conditions at a remote location to be quickly and easily emulated at a user's location. The present system is relatively simple to operate, and allows the user to utilize lighting scene information collected by all of the users in a network. Further, the needed invention takes time and date parameters into account, so as to allow for a very close approximation of the lighting conditions of the remote location at the first location based on a known event time and date, and even anticipated weather conditions. Further, retail establishments are able to utilize the system to enhance their business by allowing customers the ability to control lighting conditions at the retail location based on any desired remote location. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
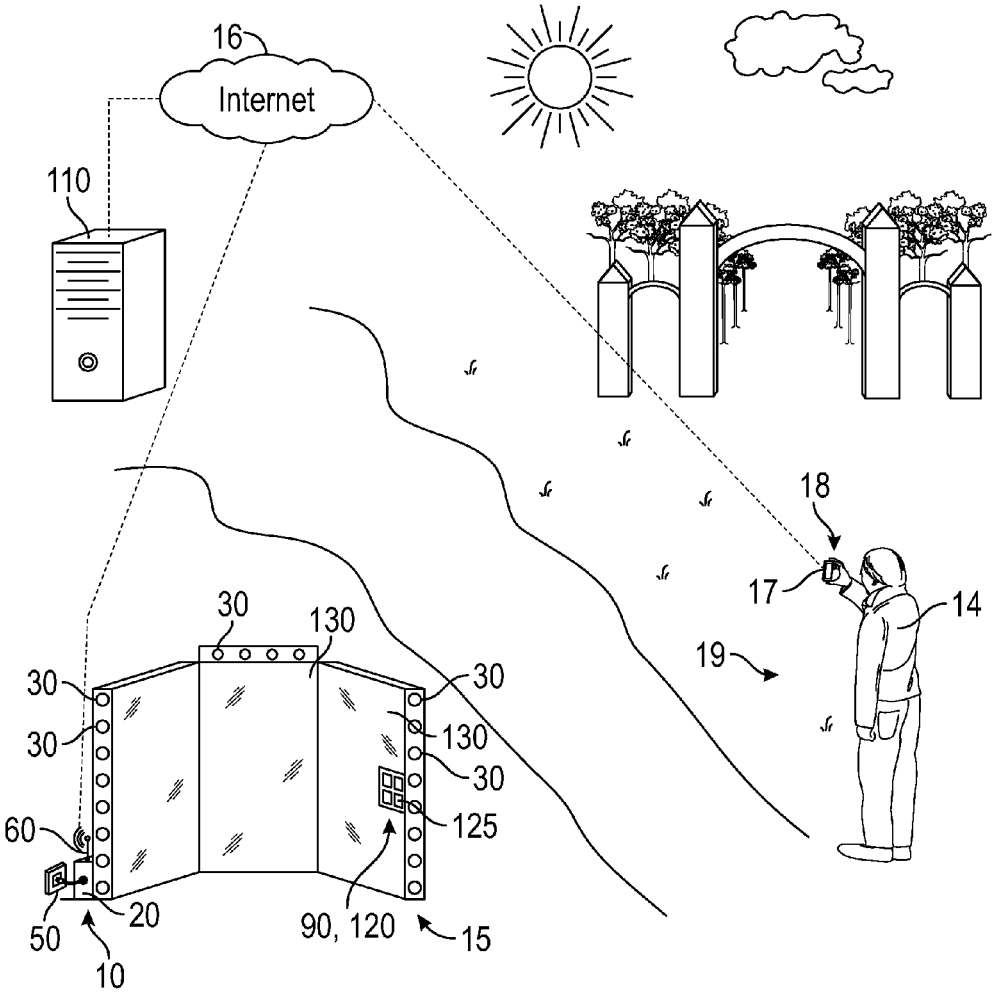
FIG. 1 is a perspective diagram of the lighting system of the present invention.
Figure 2:
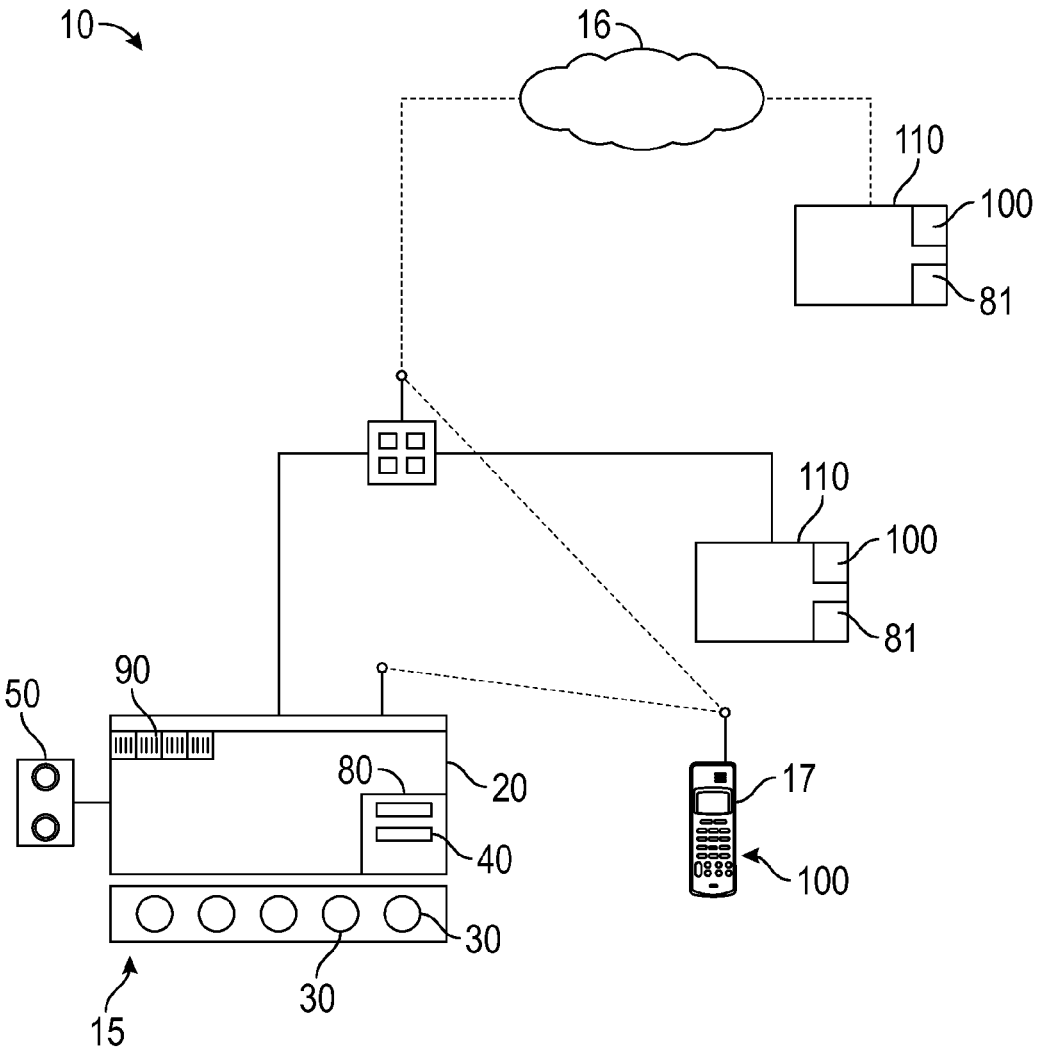
FIG. 2 is an alternate diagram of the invention.

FIGS. 1 and 2 illustrates a lighting system 10 for emulating at a first location 15, such as a residential bathroom, a retail clothing store changing room, or the like, the lighting conditions of a remote location 19, such as a wedding venue, nightclub, etc. Lighting scene information 17 can be collected at the remote location 19 by conventional means, such as a "light meter" light measuring apparatus (not shown), a camera 18 of a portable electronic device 17 of a user 14 (FIG. 2), or the like. Such lighting scene information 17 is stored in a lighting scene 40 and stored in a non-transient storage medium 81 of a remote network server 110, or stored on a non-transient storage medium 81 of the portable electronic device 17, or the like. In one embodiment, the user 14 may travel to the remote location 19, read the lighting conditions with the camera 18 of the portable electronic device 17, and then store the lighting scene 40 in the memory 81 of the portable electronic device 17 for later use.

Each lighting scene 40 is associated with the particular remote location 19 and optionally other parameters such as time of day, time of year, weather conditions, if the location 19 is indoors or outside, and the like. As such, the lighting scenes 40 of the location 19 at a given time of year, a given time of day, and with given weather conditions may be stored for later recall by the lighting system 10.

A lighting control circuit 20 includes a plurality of lamps 30 at the first location 15. The control circuit 20 is adapted to adjust the color and brightness of each of the lamps 30 to correspond with one of the plurality of lighting scenes 40. The lamps 30 are preferably of the type having color and intensity adjustment capability, such as tri-LED type lamps. Alternately, the lamps 30 may be a plurality of red, green and blue lamps that can each be varied in intensity to also adjust color, as is known in the art.

The lighting control circuit 20 further includes a power source 50, such as an AC power outlet, battery pack (not shown), or the like. A networking module 60 is included that is adapted to receive lighting scene information 70, such as color and brightens information, via a network 16, such as the Internet, cellular phone network, or the like. The networking module 60 may use a wireless protocol such as WiFi, Bluetooth, cellular, SMS, or the like, or may be plugged into a wired network. The lighting control circuit 20 further includes a non-transitory storage medium 80, such as a hard drive, solid-state drive, or the like, for storing a unique identification code 90 of the location 15 and at least one of the lighting scenes 40 (FIG. 2). At least one mirror 130 may be fixed proximate the plurality of lamps 30.

A remote command module 100 is accessible by the networking module 60 of the control circuit 20 and is adapted to provide the lighting scene information 70 of a lighting scene 40 to the lighting control circuit 20, as identified with the unique identification code 90 thereof. As such, the networking module 60 receives the lighting scene information 70 from the remote command module 100 and the lighting control circuit 20 emulates the lighting scene 40 at the first location 15 by adjusting the color and brightness of each of the lamps 30 according to the lighting scene information 70 for a particular lighting scene 40. The networking module 60 may poll a network location as specified by the remote command module 100, preferably only in a local networking environment. Alternately, the remote command module 100 may push the lighting scene information 70 to the networking module 60 as necessary, preferably in a wide area network such as over the Internet, so as to reduce load to such a wide area network. Alternate means of sending a desired lighting scene 40 to the lighting control circuit 20 may be utilized as become known in the art.

The remote command module 100 is preferably resident in a non-transitory storage medium 81 of the portable electronic device 17 of a user. The portable electronic device 17 is in wireless communication with the networking module 60 of the lighting control circuit 20. As such, the user 14 may command a change the lighting scene 40 of the lighting system 10 by using the portable electronic device 17, selecting from one of a plurality of the lighting scenes 40 that are either stored on the portable electronic device 17 or that are available for download over the network 16, for example.

The portable electronic device 17 may be in direct wireless communication with the networking module 60 of the lighting control circuit 20 via a Bluetooth, WiFi, or other wireless connection protocol on a local wireless network, for example. The portable electronic device 17 is preferably a smart phone, but may also be a dedicated remote control type of device (not shown), table computer, or the like.

In one embodiment, the remote command module 100 is resident on the remote network server 110 that is in communication with the networking module 60 of the lighting control circuit 20 through the network 16. As such, the user 14 may change the lighting scene 40 of the lighting system 10 by using the network server 110 via the network 16. For example, the portable electronic device 17 may be in indirect wireless communication with the networking module 60 of the lighting control circuit 20 via a remote network server 110 that is accessible through the network 16, such as the Internet, cellular network, or the like. As such, the remote network server 110 is in communication with the lighting control circuit 20 and can command lighting scene changes based on inputs by the user 14 with his portable electronic device 17. Preferably the user 14 at the first location 15 is prompted by the remote command module 100 for the remote location 19 to emulate, and any additional parameters to use, such as time of year, time of day, weather conditions, etc. As such, the selected lighting scene 40 may be sent to the lighting control circuit 20.

The portable electronic device 17 in such an embodiment is capable of communicating the unique identification code 90 of the lighting system 10 to the remote network server 110, so that the remote network server 110 knows which lighting control circuit 20 on the network 16 to command. Such communication of the unique identification code 90 is preferably performed by scanning a code implemented using prevalent ID technology such as QR code or bar code representing the unique identification code 90, for example, or by selecting from one of a plurality of known locations of the lighting control circuits 20 based on the location entered by the user 14 or reported by geo-location modules (not shown), such as GPS modules, on the user's portable electronic device 17.

In one embodiment, the remote command module 100 may be associated with standard users 14, and admin users (not shown). Standard users 14 may command the lighting control circuit 20 to emulate the lighting scene 40 of a particular wedding venue, for example, but after a preset period of time the lighting scene 40 reverts back to a default scene established by the admin user. Admin users may further control the duration of time that standard user lighting scene changes take effect before reverting back to the default scene, and hours of operation that standard users are allowed to make lighting scene changes. Further, admin users may change other characteristics of the lighting control circuit 20, such as blocking lighting scenes 40 from certain remote locations 19, randomly changing lighting scenes at set time intervals based on the closest or most popular remote locations 19, and the like.

The lighting system 10 may further include an indicia 120, such as a QR code 125, fixed proximate the plurality of lamps 30 (FIG. 1). The indicia 120 corresponds to the unique identification code 90 and may also be associated with a unique network address of the remote network server 110. In use the user 14, after scanning the indicia 120 or QR code 125 with a camera 18 of the portable electronic device 17, is afforded control of the lighting system 10 by the remote network server 110 through the user's portable electronic device 17. At least a portion of the command module 100 is resident on the portable electronic device 17 in such an embodiment. Further, in one embodiment, the user 14 may establish a lighting scene 40 with the lighting system 10 and then alter specific parameters such as the color or brightness of the lighting scene 40.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A lighting system for emulating at a first location the lighting conditions of a remote location, comprising:

a lighting control circuit with a plurality of lamps at the first location, the control circuit adapted to adjust the color and brightness of each of the lamps to correspond with one of a plurality of lighting scenes, and further including a power source, a networking module adapted to receive lighting scene information via a network, and a non-transitory storage medium for storing a unique identification code and at least one of the lighting scenes;

a remote command module accessible by the networking module of the control circuit and adapted to provide lighting scene information to the lighting control circuit as identified with the unique identification code thereof;

an indicia fixed proximate the plurality of lamps, the indicia corresponding to the unique identification code of the lighting control circuit, the indicia being a Quick Response (QR) code corresponding to a unique network address of the remote network server and associated with the unique identification code of the lighting control circuit;

whereby a lighting scene is assigned by the remote command module to the lighting control circuit based on the unique identification code thereof, the networking module receiving the lighting scene information from the remote command module and emulating the lighting scene at the first location by adjusting the color and brightness of each of the lamps accordingly, and whereby the user, after scanning the QR code with a camera of the portable electronic device, is afforded control of the lighting system by the remote network server through the portable electronic device, at least a portion of the command module being resident on the portable electronic device.

2. The lighting system of claim 1 wherein the remote command module is resident on a portable electronic device of a user, the portable electronic device in wireless communication with the networking module of the lighting control circuit, whereby the user changes the lighting scene of the lighting control circuit by using the portable electronic device.

3. The lighting system of claim 2 wherein the portable electronic device is in direct wireless communication with the networking module of the lighting control circuit via a Bluetooth paired connection.

4. The lighting system of claim 2 wherein the portable electronic device is in indirect wireless communication with the networking module of the lighting control circuit via a WiFi connection through the network.

5. The lighting system of claim 2 wherein the portable electronic device is in indirect wireless communication with the networking module of the lighting control circuit via a remote network server on the network.

6. The lighting system of claim 1 wherein the remote command module is resident on a remote network server in communication with the networking module of the lighting control circuit through the network, whereby the user changes the lighting scene of the lighting control circuit by using the network server via the network.

7. The lighting system of claim 1 further including a mirror fixed proximate the plurality of lamps.

8. The lighting system of claim 1 wherein the lighting control circuit further includes a timer and a default scene storable in the non-transitory storage medium, whereby a predetermined time after a lighting scene change the lighting control circuit reverts back to the default scene.

9. The lighting system of claim 1 wherein each lighting scene includes a parameter for recording the time of day.

10. The lighting system of claim 1 wherein each lighting scene includes a parameter for recording the time of year.

11. The lighting system of claim 1 wherein each lighting scene includes a weather parameter for recording a type of weather condition.

12. A lighting system for emulating at a first location the lighting conditions of a remote location, comprising:

a lighting control circuit with a plurality of lamps at the first location, the control circuit adapted to adjust the color and brightness of each of the lamps to correspond with one of a plurality of lighting scenes, and further including a power source, a networking module adapted to receive lighting scene information via a network, and a non-transitory storage medium for storing a unique identification code and at least one of the lighting scenes;

a remote command module accessible by the networking module of the control circuit and adapted to provide lighting scene information to the lighting control circuit as identified with the unique identification code thereof;

an indicia fixed proximate the plurality of lamps, the indicia corresponding to the unique identification code of the lighting control circuit, the indicia being a scan code corresponding to a unique network address of the remote network server and associated with the unique identification code of the lighting control circuit;

whereby a lighting scene is assigned by the remote command module to the lighting control circuit based on the unique identification code thereof, the networking module receiving the lighting scene information from the remote command module and emulating the lighting scene at the first location by adjusting the color and brightness of each of the lamps accordingly, and whereby the user, after scanning the scan code with a camera of the portable electronic device, is afforded control of the lighting system by the remote network server through the portable electronic device, at least a portion of the command module being resident on the portable electronic device.

* * * * *